US005205630A

United States Patent [19]

Welch et al.

[11] Patent Number: 5,205,630

[45] Date of Patent: Apr. 27, 1993

[54] MULTIPLE PURPOSE, KNOCK-DOWN MODULAR STORAGE SYSTEM AND METHOD OF ASSEMBLING SAME

[75] Inventors: Robert J. Welch, Dallas; Willard J. Sickles, Dalton; Douglas J. Kaminski, Wilkes-Barre, all of Pa.

[73] Assignee: InterMetro Industries Corporation, Wilkes-Barre, Pa.

[21] Appl. No.: 680,333

[22] Filed: Apr. 5, 1991

[51] Int. Cl.[5] ..... A47B 91/00

[52] U.S. Cl. ..... 312/249.11; 312/265.3; 312/330.1; 108/107; 108/144; 211/187

[58] Field of Search ..... 312/265.1, 265.2, 265.3, 312/265.4, 265.5, 270.3, 330.1, 249.8, 345, 348, 249.11, 404, 336, 408; 108/106, 107, 110, 111, 144, 153; 211/187, 190, 208

[56] References Cited

U.S. PATENT DOCUMENTS

| | | | |
|---|---|---|---|
| 1,631,718 | 6/1927 | Campbell | 312/265.1 X |
| 1,961,391 | 6/1934 | Reedy et al. | 312/345 |
| 3,276,832 | 10/1966 | Reilly | 312/140 |
| 3,712,696 | 1/1973 | McDonnell . | |
| 4,288,130 | 9/1981 | Baldwin . | |
| 4,811,670 | 3/1989 | Kolvites et al. | 108/111 X |
| 4,887,538 | 12/1989 | Arnold | 108/111 |
| 4,964,350 | 10/1990 | Kolvites et al. | 108/144 X |

FOREIGN PATENT DOCUMENTS

| | | |
|---|---|---|
| 2604874 | 10/1986 | France . |
| 1106545 | 5/1965 | United Kingdom . |
| 1416701 | 4/1972 | United Kingdom . |

*Primary Examiner*—Kenneth J. Dorner
*Assistant Examiner*—Brian K. Green
*Attorney, Agent, or Firm*—Fitzpatrick, Cella, Harper & Scinto

[57] ABSTRACT

A multiple use, modular, knock-down storage system has adjustable shelving and drawers, and removably attachable side panelling. The panelling is easily attached to a corner post by first attaching an inner corner member to the post, placing the panelling over that inner corner member and then laying an outer corner member over the panelling and the inner corner member. A fastener secures the entire assembly together. An adjustable and easily removable drawer support frame is also provided. The frame can be inserted into or removed from the entire storage system and can be configured with the appropriate size frames for the particular end use desired. In this manner, the storage system can easily be assembled and modified by the ultimate end user to meet whatever specific needs that user may have.

22 Claims, 6 Drawing Sheets

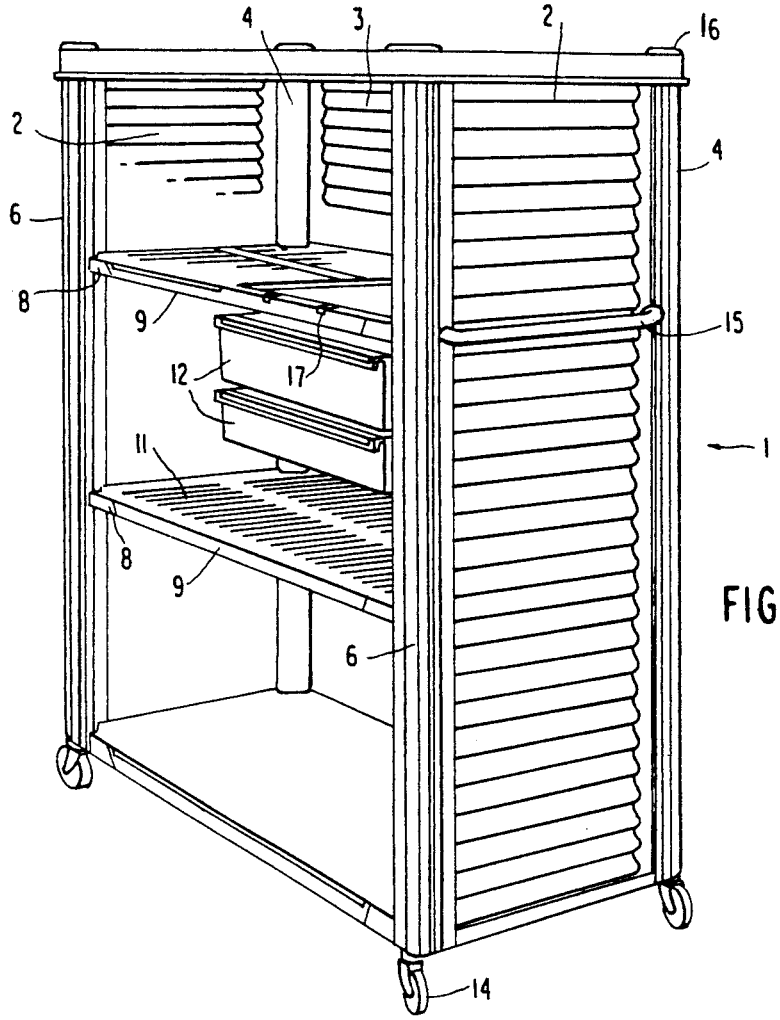
FIG. 1
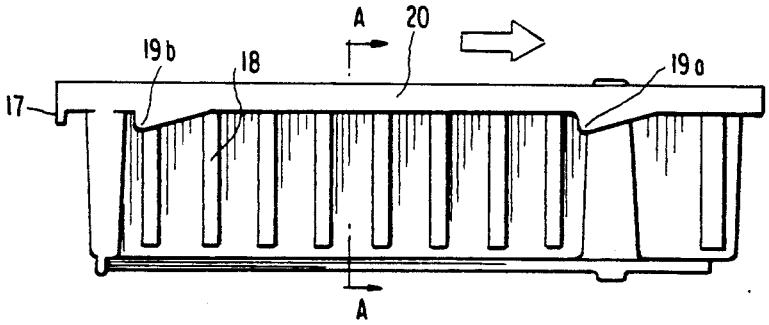
FIG. 3
FIG. 4
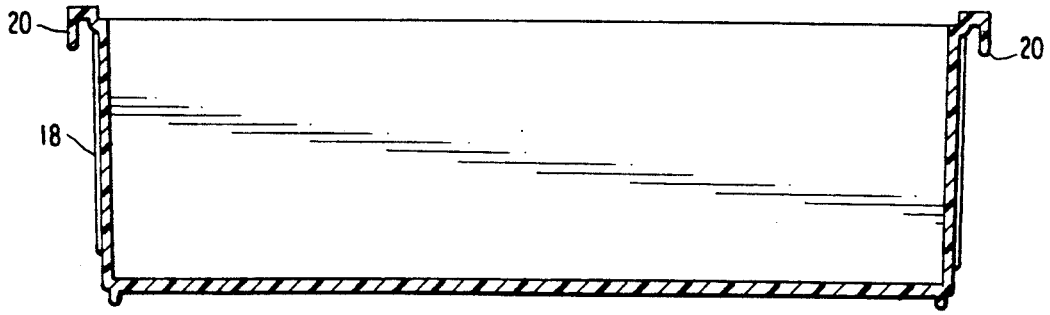

MULTIPLE PURPOSE, KNOCK-DOWN MODULAR STORAGE SYSTEM AND METHOD OF ASSEMBLING SAME

FIELD OF THE INVENTION

1. Background of the Invention

The present invention relates to a multiple purpose, modular knock-down utility storage system which can easily be modified by the user to either insert or remove side panels and to configure the interior so as to receive a variety of different numbers and sizes of drawers.

Description of the Prior Art

Modular "knock-down" utility storage systems and related shelving systems are well known in the art. Such systems are utilized for a broad variety of storage applications, including crash carts for carrying emergency medical supplies, service carts for use by the food service industry in storing and transporting a wide variety of food items of various sizes, shapes and weights, as well as other general utility functions for which a storage system is useful for storing and/or transporting items.

At present, there are a large number of knock-down utility storage systems and shelving type systems installed or available in hospitals, warehouses, grocery stores, retail stores, homes, and the like. However, there are disadvantages in many such structures. For example, some known utility storage systems tend to be difficult to assemble and disassemble in the field without special tools, and often requiring nuts, bolts, grommets, and other fasteners and tools. Such systems also require a great deal of time to assemble and disassemble to perform routine maintenance and cleaning operations.

It is also important in knock-down utility storage systems that they be versatile and easy to reconfigure in the field, thereby enabling the user to tailor the position and size of various features of the system for the particular job the system is needed to perform.

The assignee of the subject invention has developed a highly desireable line of products specifically designed to overcome the known disadvantages mentioned above and to meet the storage needs of many industries. As one example, a knock-down shelving system is shown in U.S. Pat. No. 4,811,670, wherein shelves may be easily adjusted to different heights and wherein an interior shelf may be inserted or removed from the shelving system without removing adjacent shelves or otherwise partially disassembling the overall shelving system.

In U.S. Pat. No. 4,964,350 there is shown a modular knock-down type plastic frame shelving system having adjustable height shelves adapted to be snap-fit over a rectangular support structure comprising two end beams, two side beams and a center beam connecting the two end beams. In this manner, the shelf can be easily assembled and disassembled and supported on a support post at a predetermined height. Moreover, various shelf configurations may be utilized in this system.

While the systems disclosed in these patents represent a substantial advance in the knock-down shelving art, still further beneficial improvements in the development of utility storage systems as described below may be realized.

SUMMARY OF THE INVENTION

For purposes of explanation, the present invention will be described with reference to its application as a multiple purpose, knock-down, modular utility cart. However, in its broadest aspect, this invention relates generally to a storage system that can support drawers, shelves and the like, as described below in greater detail, as well as to a storage system in which back panels and end panels are readily attached or removed.

Accordingly, it is an object of the present invention to mitigate the disadvantages of the generally know prior art and to provide still further improvements on the superior products now offered by the assignee of the subject invention.

It is another object of the present invention to provide a utility storage system which can be readily configured with drawers of the appropriate size and number necessary for the type of objects to be carried in the storage system.

It is still another object of the present invention to provide a utility storage system which permits the easy insertion and removal of drawer frames of different size.

It is yet a further object of the present invention to provide a knock-down type utility storage system which permits the easy insertion and removal of outer panelling that at least partially encloses the interior of the system.

In accordance with one aspect of the present invention, the utility storage system of the present invention comprises a plurality of substantially vertical corner posts, a plurality of side beams each interconnecting two of the corner posts, a drawer support frame removably attached to at least one of the side beams, and a drawer carried within that drawer support frame.

In accordance with yet another feature of the present invention, a utility storage system comprises a plurality of substantially vertical corner posts, a plurality of side beam, each interconnecting two of the corner posts, and a drawer support frame removably attached to the side beams by a plurality of clips. The clips are formed of a series of planar surfaces three of which are substantially adjacent the top and side surfaces of the side beams to be carried thereby. At least one drawer may be slideably contained within the drawer support frame.

The storage support system in accordance with the present invention also comprises an inner corner member having structure for embracing one side of the corner post intermediate its ends and at least one panel supporting section mounted with the embracing structure. An outer corner member is formed to mate with and be carried by the inner corner member and, in cooperation with it, at least partially envelopes the corner post. The outer corner member is formed with a confronting extension that opposes the panel supporting section. A panel has an end portion lip sandwiched between the panel supporting extension and the confronting extension. A fastener is secured through the confronting extension, the lip, and the panel supporting section, thereby to support the panenl on the corner post.

In accordance with still yet another aspect of the present invention, a utility storage system comprises a plurality of substantially vertical corner posts, a plurality of side beams, each interconnecting two of the corner posts, and an inner corner member having a generally C-shaped section that embraces and snaps partially around the corner post. The inner corner member is formed with a notch on the outer surface of the C-shaped section and includes at least one opening for receiving a fastener. An outer corner member mates with the inner corner member to at least partially envelop the corner post. The outer corner member includes a protrusion engageable with the notch on the inner corner member and has at least one opening aligned with an opening in the inner corner member when the outer corner member and inner corner members are mated together. A panel has an end portion lip sandwiched between a panel mounting section of the outer corner member and a confronting extension of the inner corner member. The end portion lip of the panel has an opening aligned with openings in the inner and outer corner members through which the fastener can pass.

In an additional aspect of the present invention provides a method of attaching panels to vertical corner posts of a storage system, the corner posts being interconnected by side beams. The method comprises the step of snapping a flexible inner corner member, having a generally C-shaped embracing portion, a notch on its outer surface, and a panel supporting section extending from the C-shaped portion, onto a corner post to embrace it at a location between its ends. An end portion lip of a panel is then positioned over the panel supporting extension, and an outer corner member is positioned with a confronting extension overlying the lip and panel supporting extension. The projection on the outer corner member is placed into the notch on the inner corner member. The panel is then secured to the inner and outer corner member by a fastener projecting through the outer corner member, the panel lip and the inner corner member.

A more complete appreciation along with an understanding of the objects, features and advantages of the present invention will become apparent from the following detailed description, when considered in conjunction with the accompanying drawing.

BRIEF DESCRIPTION OF THE DRAWING

FIG. 1 is a perspective view of a mutiple purpose, knock-down, modular storage system incorporating the present invention.

FIG. 3 is a side view of a drawer used in conjunction with the present invention.

FIG. 4 is a cross-sectional view taken on plane A-A in FIG. 3 of the drawer shown there.

DETAILED DESCRIPTION OF THE INVENTION

For purposes of explanation only, the features of the present invention will be described as they are incorporated in a knock-down, modular utility cart having a removably mountable drawer and drawer support frame and detachable rear and side panel members. It should be understood, however, that these features are not so limited to a utility cart, but rather are adaptable generally and with equal advantage to many other types of storage systems.

Figure 2:
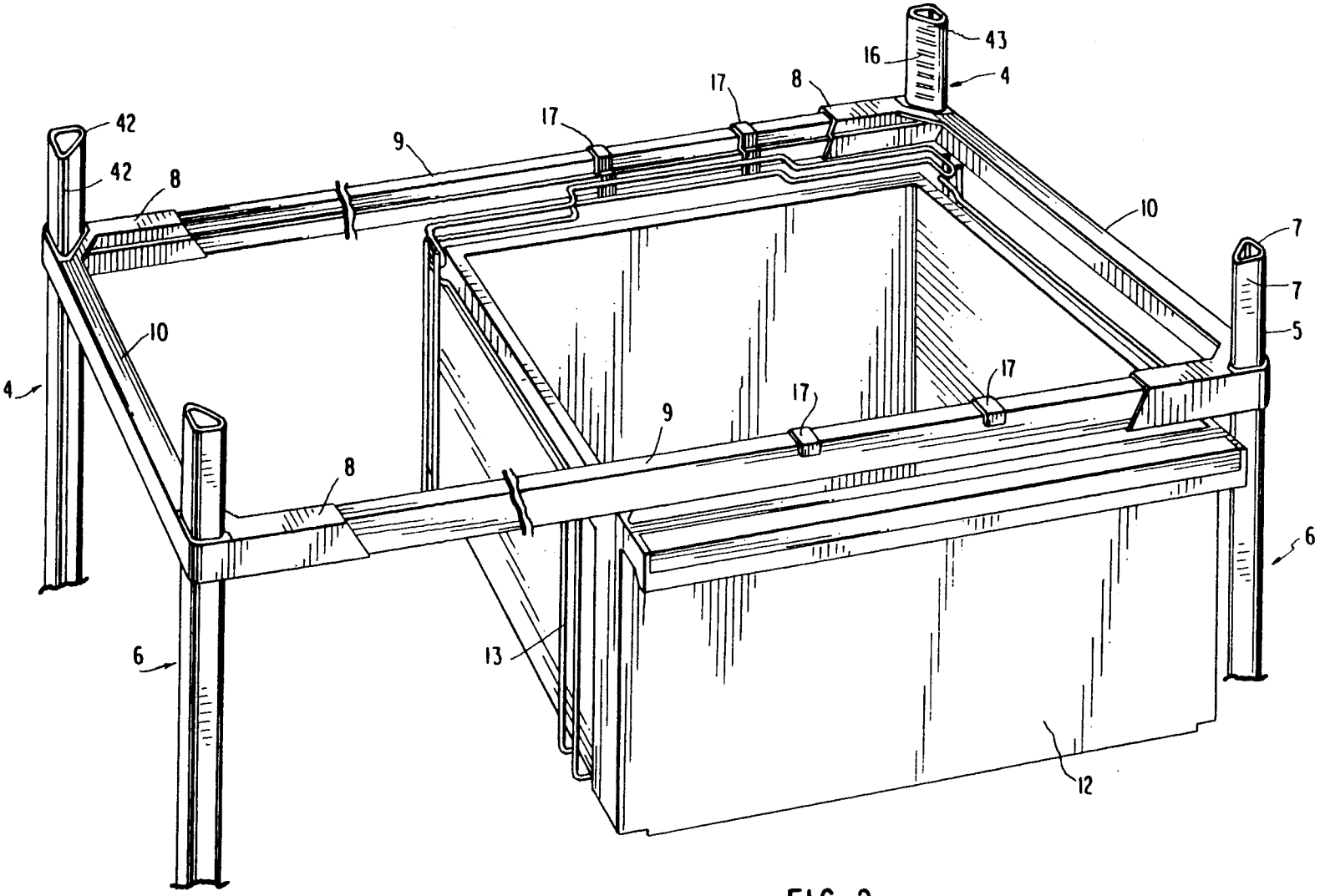
FIG. 2 is a perspective view of the interior of the storage system illustrating the attachment of a drawer and drawer frame.

FIG. 1 is a perspective view of a utility cart 1 having a pair of drawers 12 therein. FIG. 2 is a partial perspective view of a drawer support frame 13 and drawer 12 mounted in such a storage system. Together, FIGS. 1 and 2 illustrate a basic configuration for a knock-down storage system incorporating features of the present invention.

Generally speaking, the utility cart 1 depicted in FIGS. 1 and 2 includes two substantially vertical rear corner posts 4 and two substantially vertical front corner posts 6, that may be made and assembled in accordance with the invention disclosed in either of U.S. Pat. Nos. 4,811,670 or 4,964,350, which are incorporated herein by reference. Rear corner posts 4 are those positioned at the back of the utility cart 1 when viewing it from the direction in which the drawers 12 are inserted. Front corner posts 6 are those positioned at the front of the utility cart 1 when viewing it from that same direction.

The rear corner posts 4 and front corner posts 6 are respectively connected to each other by side beams 9. End beams 10 are provided to interconnect the left front corner post 6 to the left rear corner post 4 and the right front corner post 6 to the right rear corner post 6, respectively. As explained in more detail below, the side beam 9 and end beam 10 structures may have, at least in part, the cross-section of a box beam and form surfaces on which shelving and drawer holding devices may be mounted. Indeed, the end beams, side beams and corner post, as well as the manner of assembling them all preferably may be in accordance with the disclosure of U.S. Pat. No. 4,964,350. More specifically, each corner post comprises a pultruded thermosetting plastic body, preferably thermosetting polyester, having unidirectional E Glass or other fibers extending therethrough, a random weave mat for providing torsional strength in the thermosetting plastic body, and a thermoplastic coating preferably ABS or PET plastic, bonded to the outer surface of the thermosetting plastic. Alternatively, a thermosetting plastic coating or skin may be applied to the thermoplastic body. The coating provides a durable, impact resisting surface and prevents wicking of moisture into the fibers in the plastic body. In addition, the side beams 9 and end beams 10 can be made of pultruded thermosetting resin and are also coated with an ABS or PET plastic skin, in the same fashion as are the corner posts. Again, a thermosetting plastic can be used as the coating.

Figure 12:
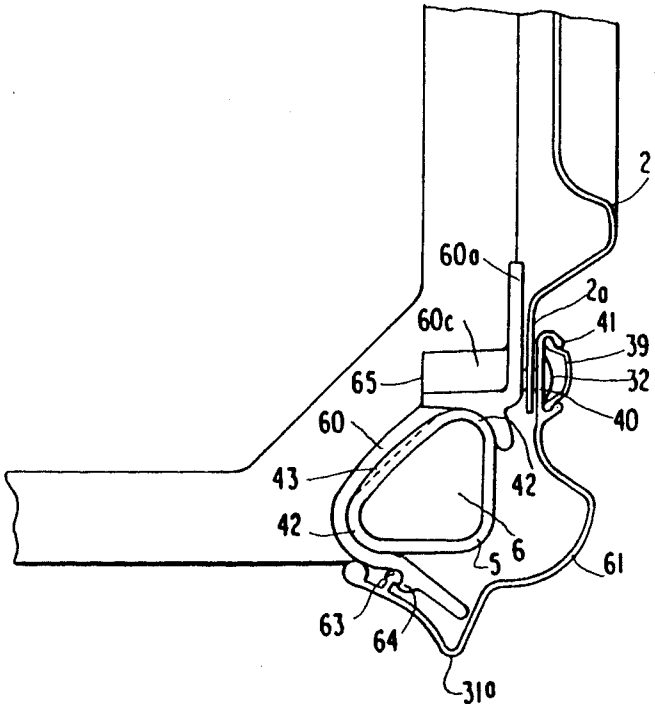
FIG. 12 is a cross-sectional view of a front corner post having a side panel connected thereto.
Figure 13:
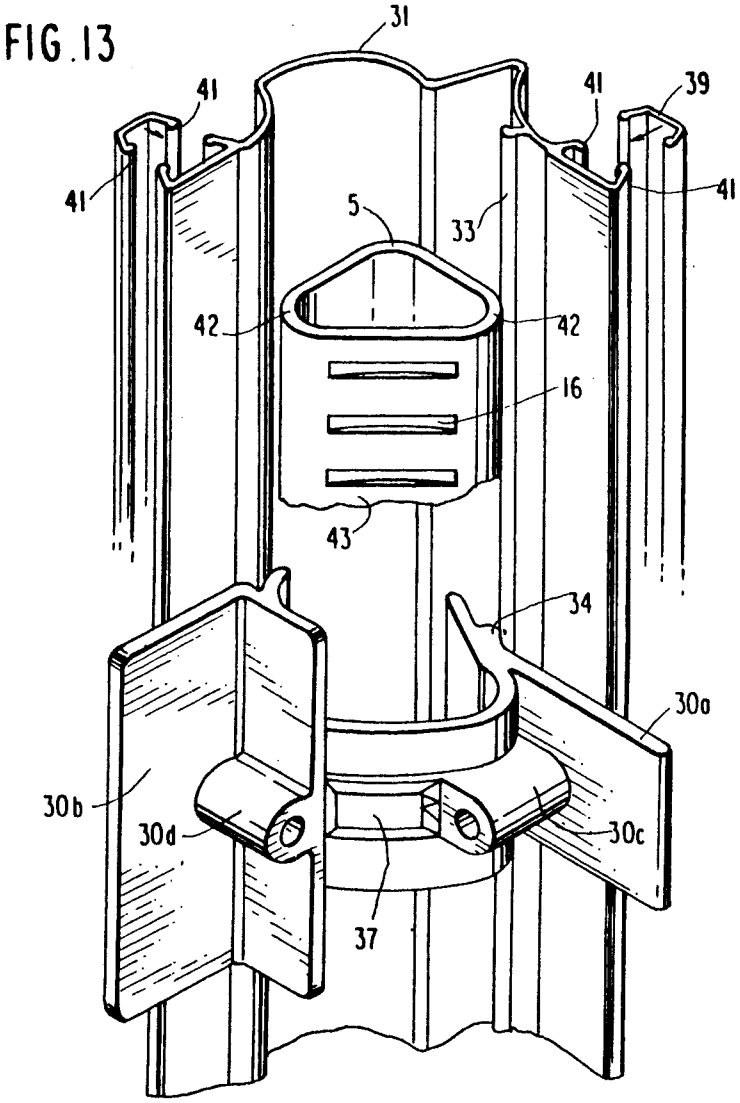
FIG. 13 is an exploded perspective view showing the method of attaching the inner corner member, outer corner member and corner snap covers.

Each corner support post has a generally right equilateral triangular cross-section in which the angular apexes are rounded. As shown in FIG. 2 and can also be seen in FIGS. 9 and 11 to 13, the right angular apex 5, and two flat exterior sides 7 face the exterior of the corner support post assembly and two interior angle apexes 42 and flat interior side 43 of each support post face the interior of the corner assembly. A number of detent steps 16 are formed or machined at periodic intervals along the vertical length of the interior side 43 of each support post as seen in FIGS. 2, 10 and 13. The depth of these detent steps, which is preferably approximately 0.05 inch, is less than the thickness of any thermoplastic or thermosetting coating applied to the corner post. As a result, the structural integrity of the underlying thermoplastic body is not compromised. The use of a generally triangular cross-section not only maximizes the available shelf space, but also provides multidirectional structural stability as explained in greater detail in U.S. Pat. Nos. 4,811,670 and 4,964,350.

The end beams 10 and side beams 9 are firmly attached to the corner posts and are vertically adjustable. As noted, one means by which end beams 10 and side beam 9 may be adjustably attached to the corner posts is disclosed in U.S. Pat. No. 4,964,350. However, it should be understood that any suitable means for attaching these support beams is within the scope of the invention.

A center beam (not shown) may be inserted between end beams 10 parallel to side beams 9 to increase the load bearing capability to the system. Each can be made of pultruded thermosetting resin and, like the corner posts, may also be coated with a thermosetting or theremoplastic skin.

Returning to FIGS. 1 and 2, a plurality of shelf mats 11 may be adapted to be snap-fit onto the frame as described in detail in U.S. Pat. No. 4,964,350. End beams 10, side beams 9 and, where appropriate, center beams (not shown) stably support the shelf mats 11.

Each end beam 10 is formed with a corner structure that is secured at a fixed height to the corner posts to locate each beam frame and shelf assembly by cooperating wedge members (not shown) described in detail in both patents mentioned above. This structure permits the insertion or removal of an assembled shelf or shelf frame, as defined by the side and end beams, located in the interior of the shelving system without removing adjacent shelves or shelf frames or partially disassembling the shelving system.

In accordance with the present invention, one or more of the shelf mats 11 described above may be removed or omitted and one or more drawer frames 13, for slidably carrying at least one drawer 12, may be mounted in the shelf frame instead. Although in the embodiment shown in FIGS. 1 and 2 the frame 13 and drawer 12 are suspended below the side beams 9, as will be explained later the drawer frame 13 and drawer 12 may also be mounted on top the side beams 9.

Still speaking generally, attached to the rear and ends of the utility cart 1 are a back panel 3 and end panels 2 that enclose the interior of the cart on three sides. The panels in this embodiment are light weight, vacuum formed vinyl sheets. However, any material with satisfactory manufacturing properties, durability and light weight may be used. As will be explained in more detail below, the panels are easily removed and reattached by the user, which facilitates cleaning and other maintenance operations. Of course, only selected panels may also be removed to allow the utility cart 1 to carry items of much larger size and also to provide access to the interior of the storage system from directions other than the front.

There may also be provided a front door or cover (not shown) that is hung on the front of the utility cart 1 to completely enclose the interior and secure its contents. In this embodiment, a soft door is preferred. That door may be held at the top by an extrusion slipped onto the top shelf and at the bottom by velcro-type fasteners.

Casters 14 may be provided at the base of each of the corner posts 4 and 6 thereby to provide easy mobility. A handle 15 may be incorporated to assist the user in pushing or pulling the cart 1. Of course, upon application of the invention to a shelving or other fixed storage system, the casters 14 and handle 15 would not necessarily be included.

In its preferred form, the corner posts will be hollow so as to lower weight and cost. Accordingly, a cap 16 may be provided at the top of each. The cap 16 prevents unwanted materials from entering the hollow interiors of the corner posts and also will cover any jagged ends resulting from minor imperfections in the manufacturing process.

Now the drawer carrying frames and drawers mounted therein in accordance with the present invention will be described in detail.

More particularly, the drawer frame 13 is preferably a wire structure designed to be mounted above or below the shelf frame comprising the side and end beams. In the preferred embodiment, the wire frame is manufactured of metal wire approximately one quarter inch in diameter. Steel is preferred. However, any material having sufficient strength and durability to support drawers and their contents and which may be manufactured to the appropriate dimensions may be utilized and is within the scope of this invention.

FIG. 2 is a perspective view of the manner in which a "down-side" drawer support frame 13 (that is, one that hangs below the support beams 9) is removably attached to the side beams 9. The attachment is made by means of clips or hangers 17, of which there preferably are four. Two of the clips 17 rest over one side beam 9 interconnecting the rear corner posts 4 thereby to mount the rear portion of the drawer support frame 13. At the same time, the front of the drawer support frame 13 is supported by two similar clips or hangers, attached to the front end of the frame 13 and resting on the side beam 9 spanning the front corner posts 6 at the front of the utility cart 1. Once the drawer frame 13 is thus secured in position, one or more drawers 12 of appropriate size may be mounted therein.

Figure 6:
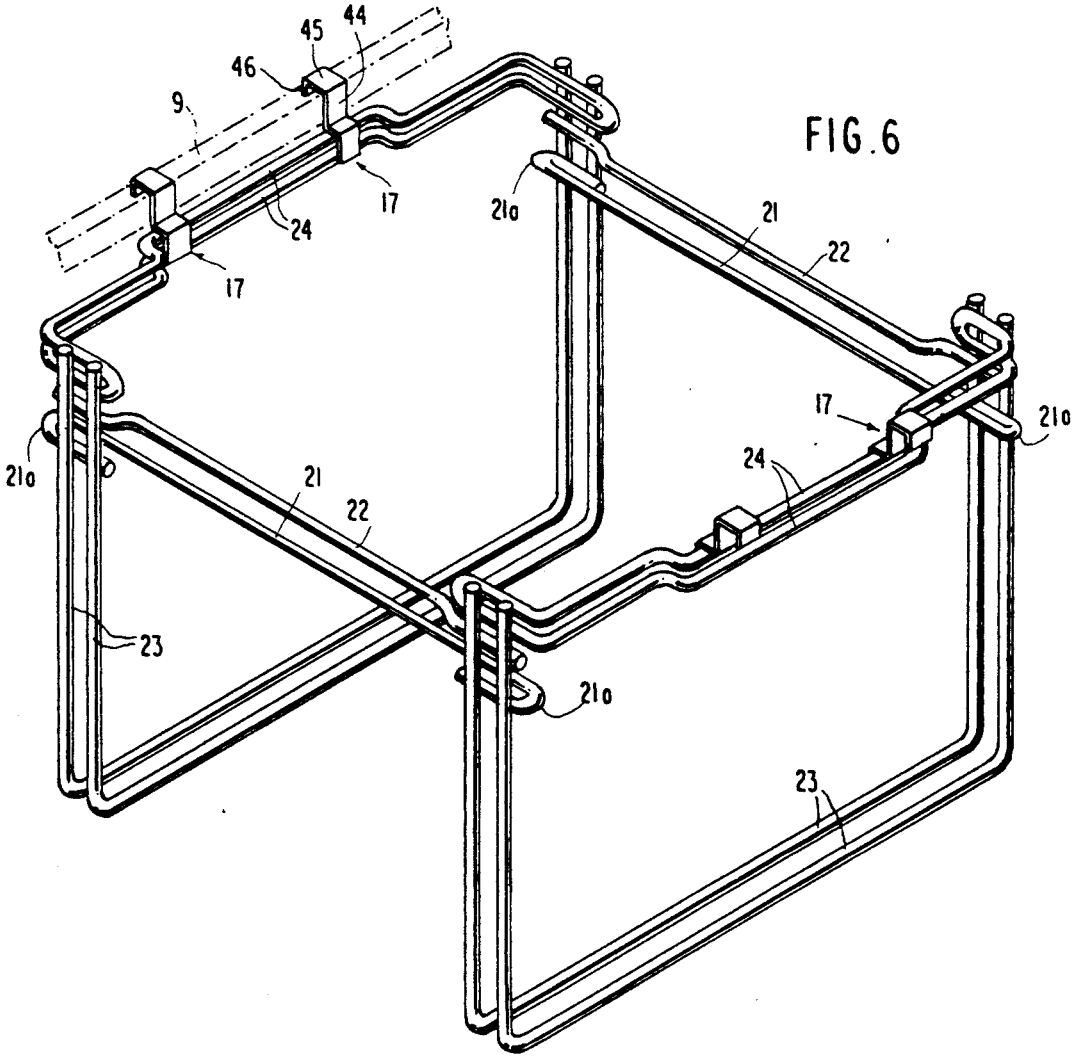
FIG. 6 is a partial perspective view of a "bottom-side" drawer frame in accordance with the present invention.
Figure 8:
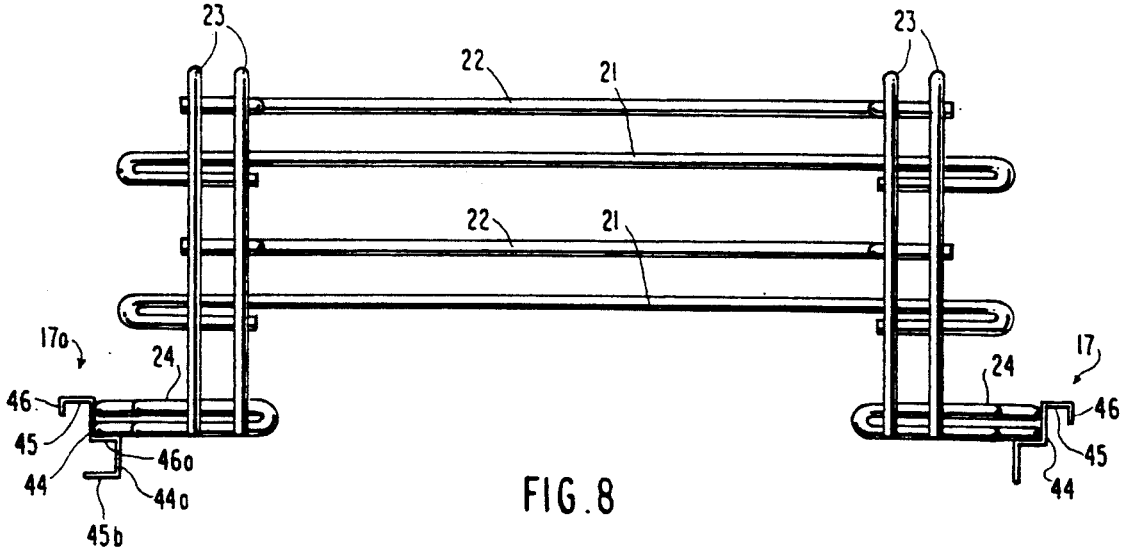
FIG. 8 is a side view of the top-side drawer frame shown in FIGS. 5 and 7.

Each clip or hanger 17 is manufactured from the same material as the wire drawer frame 13 and, when metal is used, is welded to frame 13. The hangers 17 are shaped to fit over the side beam 9 and will do so in a manner whereby the weight of drawer frame 13 and drawer 12 secure the clips 17 in position. Generally, as shown in FIGS. 6 and 8, the clip 17 will have at least three flat surfaces 44, 45 and 46 bent at consecutive right angles to one another to form a hook that is engaged over the side beam 9. The planar surfaces 44 and 46 are substantially vertical and the planar surface 45 connecting them is substantially horizontal. The length of planar surface 45, as measured along a line perpendicular to its intersection with planar surfaces 44 and 46, is slightly larger than the thickness, as measured horizontally, of side beam 9. However, it should only be large enough to allow the clip 17 to fit snugly over the side beam 9 to secure the drawer frame 13 in place. In addition, the rearmost clips 17*a*, shown to the left in FIG. 8, have flat surfaces 44*a*, 45*a*, and 45*b*. The lower-most of surface 45b extends horizontally and will engage the underside of a side beam to prevent the drawer frame from tipping when a drawer is pulled out from it.

FIGS. 3 and 4 show a side view and vertical cross-sectional view, respectively, of a drawer 12 that may be used in the present invention. Although, not shown, the drawer may also incorporate a cover to more adequately secure its contents. The drawer 12 slides into drawer frame 13 mounted in the utility cart 1 from left to right in a direction of the arrow shown in FIG. 3. A handle 17 is provided on the front of the drawer 12 to facilitate sliding it in and out of the drawer frame 13. Ribs 18 are formed on the side of drawer 12 in order to improve structural integrity. These ribs 18 provide a corrugation that forms generally vertical grooves (not shown) on the interior of the side of the drawer that may receive and support drawer dividers (not shown). Furthermore, by forming the drawer sides in this way, they have uniform wall thickness.

As further shown in FIG. 4, rails 20 formed along each side of the drawer end are shaped to fit over drawer support rails 21 on the drawer frame 13, thereby providing hanging support for the drawer 12 again as will be described in greater detail below. As can be seen in FIG. 3, a downwardly projecting stop 19a and a similar detent 19b, having less depending height than step 19a, are formed on the bottom edge of each rail 20. The detent 19b lightly retains the drawer in its retracted position in the frame and the stop 19a prevents the drawer 12 from inadvertently being pulled completely out of frame 13, as will be described in greater detail below.

FIGS. 5, 6, 7 and 8 illustrate various additional aspects of the removably mountable drawer support frame 13 and the way in which it cooperates with the drawers of the design described above, in accordance with the present invention. Each drawer frame may be specifically configured to hold specific numbers and sizes of drawers. Also, as will be further described each frame may have either a top-side or bottom-side configuration. Nevertheless, in the preferred embodiment of the invention, there are certain components that are common to all frame arrangements.

Referring first to FIG. 6, which illustrates a hanging or bottom-side configuration, the lower portion of the frame consists of two double-wire U-shaped frame members 23, one at each of the front and rear of the frame 13. Each double-wire U-shaped frame member 23 forms three sides of a rectangle and is positioned with its open side facing upwardly. Each rectangle is completed by attachment across the top of a double wire cross bar 24, to which the clips 17 are secured. The two complete rectangular portions of the frame are positioned apart by approximately the depth of the utility cart 1 (that is, the distance between front and rear side beams 9), and are connected on each side by at least one drawer retainer 22 and one drawer guide rail 21 to complete the frame.

Figure 5:
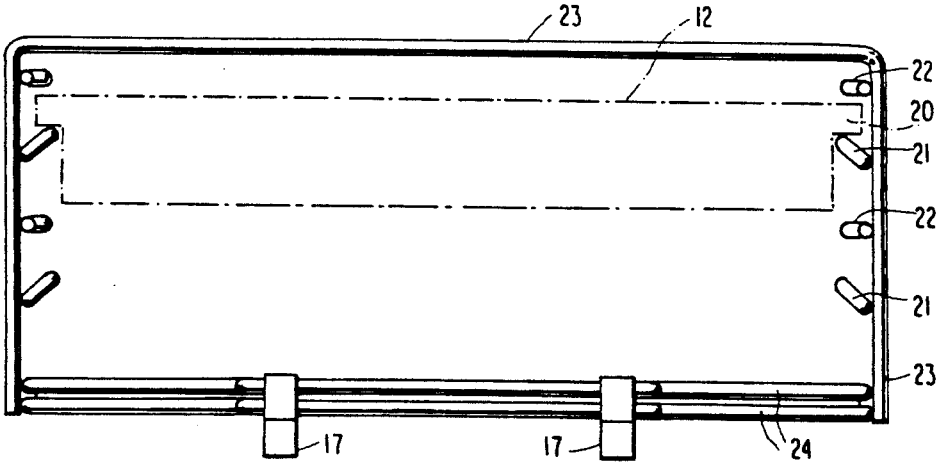
FIG. 5 is an end view of a "top-side" drawer frame in accordance with the present invention.
Figure 7:
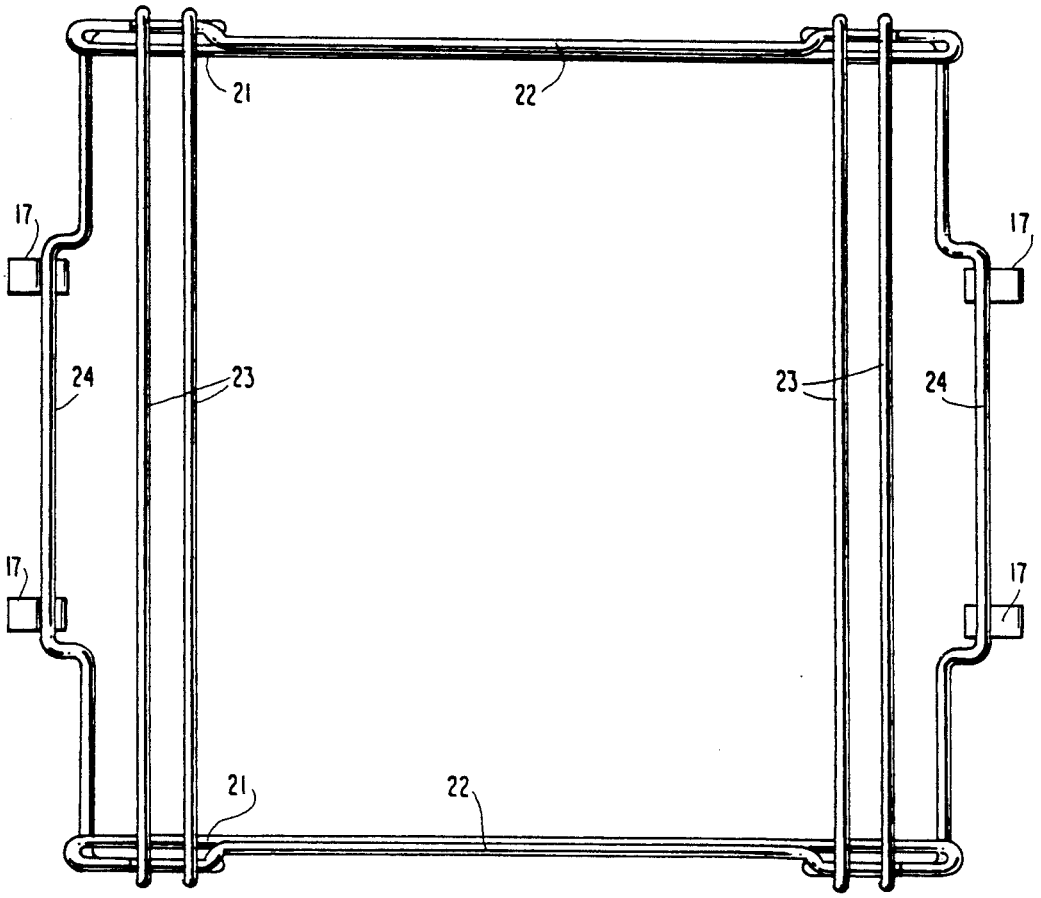
FIG. 7 is a top plan view of the top-side drawer frame shown in FIG. 5.

FIGS. 5, 7 and 8 show the construction of a top-side drawer frame which is substantially the same as the bottom-side frame shown in FIG. 6 except that the open sides of the double wire U-shaped frame members 23 are at the bottom of the rectangle defined partially thereby and each rectangle is completed by attachment of double wire cross bar 24 across the bottom. The clips 17 are attached to double wire cross bar 24 in an inverted attitude in the top-side frame when compared to that in which they are attached to the bottom-side frame.

FIGS. 7 and 8 show plan and side views of the top-side drawer frame, respectively. Clips 17 are welded to double wire cross bars 24 which, from the angle of view in FIG. 7, appear as a single cross bar because one is directly behind the other. Each double wire U-shaped frame member 23 is positioned at each end of the drawer frame 13 with the open side facing downwardly. The double wire extends across the top of the frame as shown in FIG. 7 and thereafter bends at approximately a 90° angle to traverse downwardly, as shown in FIG. 8, to intersect the lower cross bars 24. The U-shaped frame members 23 and cross bar 24 preferably are connected by welding.

Referring again to FIG. 5, which is an end view of the top-side drawer frame, each double wire U-shaped frame member 23 appears as only a single wire because, from this point of view, one wire is directly behind the other and cannot be seen. The cross bar 24 is welded to both wires of U-shaped frame member 23 to complete the rectangle. Clips 17 are welded to cross bar 24.

A drawer 12, which is shown in phantom, may be mounted in the frame 13 with the frame guide rails 21 supporting the drawer rails 20, thereby providing slidable support as it is inserted into drawer frame 13. The drawer retainer 22 overrides the drawer rail 20 and prevents the drawer from tipping downwardly when pulled out of the frame.

As can be seen, in this particular case, two smaller drawers may be inserted into the single frame of FIG. 5. However, should the user desire, the frame of FIG. 5 may be used to mount a single large drawer. Of course, other drawer configurations may be contemplated.

The guide rails 21 and drawer retainers 22 may be of differing designs, each adapted the particular function to be performed. As shown, in the preferred embodiment each guide rail 21 is bent 180° at each end, before it is attached to U-shaped frame members 23, thereby to form loops 21a. As a result, the guide rail 21 continues to engage the drawer rail 20 well beyond the point of attachment of the guide rail 21 to U-shaped cross bar 23. The forward most loops 21a engage the detent 19b and stop 19a on the drawer rail respectively to retard and thereafter prevent outward movement of the drawer from the frame.

Now, the components that attach the end and rear panels to the corner posts and the method of doing so will be described with reference to FIGS. 9 to 13. FIGS. 9, 10, 11 and 13 illustrate the attachment to a rear corner post 4 of both an end panel 2 and a rear panel 3. FIG. 12 illustrates the attachment to a front corner post 6 of only the end panel 2. This aspect of the invention will first be described with reference to the rear corner post 4 assembly.

Figure 11:
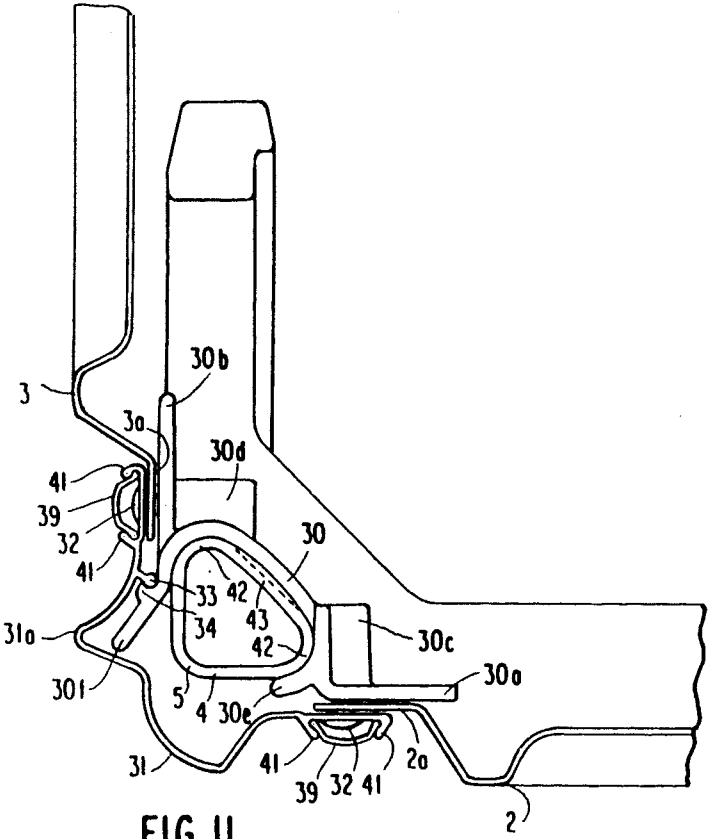
FIG. 11 is a cross-sectional view of a rear corner post having a rear panel and an end panel connected thereto.

FIG. 11 shows a top cross-sectional view of a rear corner post 4 after assembly is complete and an end panel 2 and a back panel 3 have been attached. An inner corner member 30 has a generally C-shaped cross-sectional portion. The generally C-shaped portion 30 has panel supporting sections 30a and 30b extending tangentially to the C-shaped portion and extending perpendicularly to one another. The sections form flat surfaces over which may be laid end lip portions 2a and 3a of panels 2 and 3, respectively. Also forming a part of the inner corner member 30 and integral with it are fastener-receiving sections 30c and 30d. Fastener-receiving sections 30c and 30d are positioned at the base of the sections 30a and 30b and extend in a direction substantially perpendicularly to them. Each fastener-receiving section has a bore 35 into which a fastener 32 may extend and be secured.

Two locating tabs 36 are formed on the inner surface of the generally C-shaped portion of the inner corner member 30. Each locating tab 36 is designed to engage a detent step 16 when the inner corner member 30 is mounted on the corner post 4. Tabs 36 are therefore thinner than the detent steps 16 of the corner posts and project outwardly less than the depth of each detent step 16. Also, in the preferred embodiment, the distance between tabs 36 is twice the distance between two adjacent detent steps 16. Centrally located on the generally C-shaped portion of the inner corner member is window 37 having a marker 38. The marker 38 is positioned equidistant between projections 36. The window 37 and marker 38 thereby may be utilized during installation to align the inner corner member 30 so that the tabs 36 properly engage the detent steps 16 and so that four such corner members 30 may be mounted at this same height on each corner post. The detent steps 16 may be numbered consecutively to assist mounting of the inner corner members on two or more posts at the same height. More specifically, as shown in FIG. 10, it can be seen that by aligning marker 38 through window 37 with the center of any one of the detent steps 16, the tabs 36 will be aligned with and properly engage the immediately adjacent detent steps 16 once the inner corner member is snapped into position.

The inner corner member 30 is manufactured, preferably by injection molding, from a flexible material with sufficient stiffness to provide adequate support. It is attached to the corner post 4 by pressing the open end of the generally C-shaped portion over the interior flat surface 43 of corner post 4 thereby snapping it into position. More particularly, the side legs **30*e*, 30*f* of the C-shaped portion embrace the vertexes of the corner post as shown in FIG. 11**.

A notch 34 is formed on an area of the outer surface of the side **30*f* of the generally C-shaped portion of the inner corner member 30. As will be described in greater detail below, the notch 34 engages a projection 33 on an outer corner member or cover 31**.

Inner corner member 30 need not cover, and preferably does not cover, the entire length of the corner post 4. As illustrated in FIG. 13, the inner corner member preferably need only be of a height sufficient to allow two tabs 36 securely to engage the associated detente steps 16 and sufficient to receive and secure fasteners 32 in fastener receiving sections **30*c* and 30*d***.

Once an inner corner member 30 has been attached by snapping it onto back corner post 4 as described above, end lip portions **2*a* and 3*a* of the end panel 2 and rear panel 3, respectively, are placed over and flush to inner corner member panel support sections 30*a* and 30*b* to be against them. More particularly, an end lip 2*a* of end panel 2 has at least one hole and is placed flush with section 30*a*, overlapping the fastener receiving section 30*c*. The hole in the end portion 2*a* is aligned with the bore 35 in the fastener-receiving section 30*c*. Similarly, the end portion 3*a* of rear panel 3 also includes at least one panel hole and is placed substantially flush with the section 30*b*, overlapping fastener-receiving section 30*d*. The hole in the end lip 3*a* is aligned with the bore 35 in fastener-receiving section 30*d***.

Next, an outer corner member 31, which has two confronting extensions **40*c* and 40*d*, each of which is formed with a hole 40*a* and 40*b* for receipt of fasteners 32, is placed over the rear corner post 4 from the direction of the outer angular corner apex 5. Unlike the inner corner member 30, the outer corner member 31 may be a highly flexible, and is preferably an extruded part that extends the entire length of the corner post 4 to cover its exterior and, with the inner corner members, at least partially envelop the corner post. More particularly by extending the full length of the corner post 4, the outer corner member 31 covers the edges of the end panel 2 and the back panel 3** thereby improving the overall appearance of the storage system.

As shown in the Figures, the confronting extension **40*c* of the outer corner member 31 covers the end portion lip 2*a* of rear panel 2. The confronting extension 40*d* similarly covers the end portion lip 3*a* of the rear panel 3. The outer corner member 31 also includes a protruding portion 31*a* that accommodates the outwardly extending portions of the generally C-shaped section of the inner corner member 30**.

The outer corner member 31 also is formed with a bulbous bead 33 that faces inwardly toward the corner post 4 and is positioned to engage the notch 34 on inner corner member 30 when outer corner member 31 is brought into position. FIGS. 11 and 12 show the engagement of these elements more clearly. Specifically, once the inner corner member 30 has been snapped onto the rear corner post 4 and panels 2 and 3 are positioned so that the panel openings in end portions **2*a* and 3*a* are aligned with bores 35 in fastener-receiving sections 30*c* and 30*d*, the outer corner member 31 is placed over the corner post 4. The bead 33 engages the notch 34 and the fastener-receiving holes 40*a*, 40*b* in the outer corner member 31 are then easily positioned over bores 35 and the holes in panel end lips 2*a* and 3*a*. Fasteners 32 are then inserted through the fastener-receiving holes 40*a*, 40*b*, and holes in the lips 2*a* and 3*a*, and into bores 35 of the fastener-receiving sections 30*c* and 30*d*** to secure the corner assembly structure.

In the preferred embodiment, fastener-receiving holes **40*a*, 40*b* in the outer corner member 31 are bordered by retaining flanges 41. A snap cover 39 may then be inserted between the flanges 41 to cover the fasteners 32** so to cover them.

Figure 9:
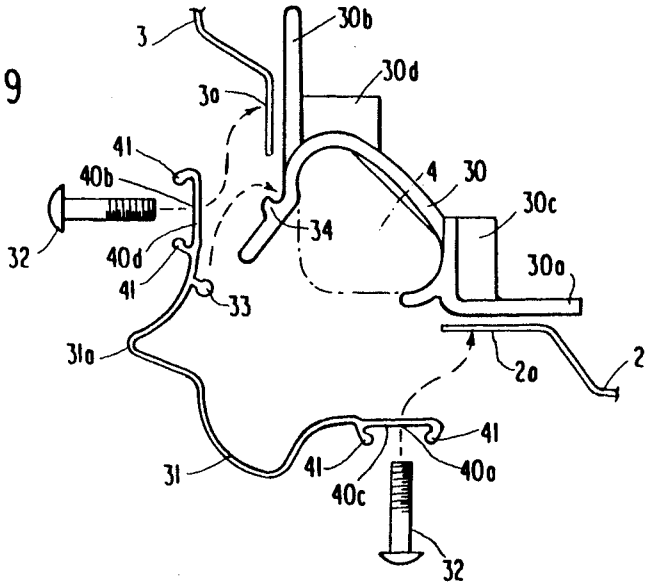
FIG. 9 is a partially exploded cross-sectional view showing the interrelation of the inner corner member, outer corner member, and the panel lip.
Figure 10:
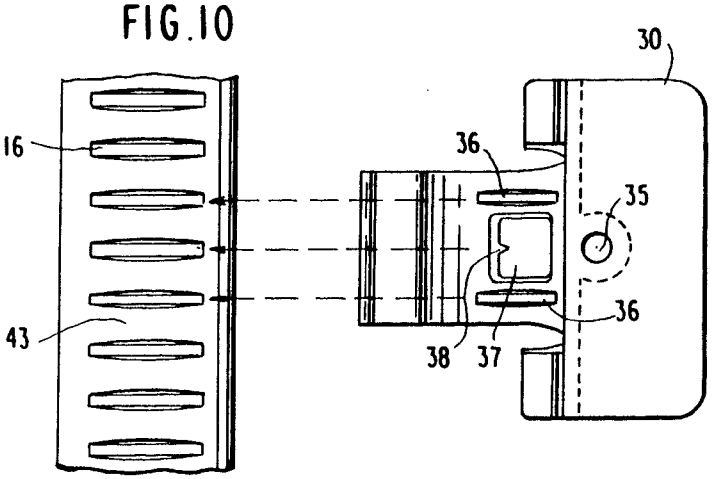
FIG. 10 is a side view showing the step of attaching an inner corner member to a corner post.

As shown in FIG. 9, the fasteners 32 may be conventional self-tapping screws. However, the invention is not so limited. The fasteners may take the form of removable plastic rivets or friction fit push pins. It should also be recognized that other means of fastening will be apparent to those skilled in the art and are therefore within the scope of this invention.

FIG. 12 illustrates a cross-sectional view of the means for attaching a side panel to a front corner post 6 with the front of storage system remaining open to receive items for storage. This structure differs from that for the rear corner posts 4 in that the front corner post 6 mounts only an end panel 2 and not the back panel 3. The generally C-shaped portion of the front inner corner member 60 remains generally of the same configuration. However, the inner corner member 60 contains only a single extension **60*a* and fastener-receiving section 60*c*. Extension 30*b* and fastener-receiving section 30*d* of the rear corner member 30 have been omitted. The front outer corner member 61 no longer requires a hole 40*b* and thus terminates immediately after the bead 63, thereby eliminating the area of hole 40*b* and its associated flange 41**.

The method of attaching end panel 2 to front corner post 6 is substantially the same as attaching a single end panel to the rear corner post 4. The front inner corner member 60 is attached to the front corner post 6 by snapping the generally C-shaped portion over the interior flat surface 43 of front corner post 6 and around the adjacent vertices to embrace them. The end portion 2a of end panel 2 is then positioned so that it overlaps the fastener-receiving section 60c and a hole in the end panel is aligned with a bore 65 in fastener-receiving section 60c. The outer corner member 61 is placed over the corner post structure by first placing the bead 63 into the notch 64 on the inner corner member 60, as shown, and then laying the outer corner member 61 over the corner post 6 and aligning the hole 60a in outer corner member 61 with the hole in the end panel 2 and bore 65 in fastener-receiving section 60c. A fastener 32 is then inserted through hole 40a and the hole in the panel into the bore 35 of fastener-receiving section 60c, thereby securing the end panel 2 to the unit. A snap cover 39, which is the same as that described with reference to the rear corner assembly, is then placed over fastener 32 in the same manner.

As noted, the end and rear panels may be vacuum-formed and, as shown in FIG. 1, have horizontally corrugated sections that at each side terminate in the lips 2a and 3a. To simplify manufacturing, a large panel sheet may be made at one time with a large number of such horizontally corrugated sections joined by flat connecting sections similar to the lips. Panels of desired widths, depending on the desired width of the storage system, may be cut from the large panel sheet by selecting the number of corrugated sections necessry to define the desired panel width and then cutting the bounding flat section in two. It will be understood that storage systems in this scheme would be available in integral multiples of a given width such as twelve inches. The corrugated sections of the rear panel sheet would then also have integral multiples of such given width.

Each of the components of the storage system may be easily and inexpensively manufactured. Although specific examples are disclosed in detail above, other materials and manufacturing techniques may be used according to the application which the storage system of the invention is to be put.

Although specific embodiments of the present invention have been described above in detail, it will be understood that this description is merely for purposes of explanation. Modification of the preferred embodiments described herein may be made by those skilled in the art without departing from the scope of the present invention which is set forth in the following claims.

What is claimed is:

1. A multiple purpose, modular storage system, comprising:

a plurality of substantially vertical corner posts;

a plurality of beams each interconnecting two of said corner pasts;

a drawer support frame including means for removably supporting said frame on at least one said beam, wherein said drawer support frame comprises two U-shaped frame members, two cross bars each enclosing an open side of one of said U-shaped frame members, and a plurality of drawer guide rails each connecting one of said U-shaped frame members to the other thereof; and at least one drawer slidably carried in said frame.

2. A storage system according to claim 1, wherein said supporting means includes at least one clip means formed to embrace a portion of said one beam.

3. A storage system according to claim 1, wherein the supporting means includes at least one clip means formed by a plurality of planar surfaces, three of said planar surfaces lying closely adjacent a top and two sides of said one beam.

4. A storage system according to claim 1, wherein said drawer is formed with a plurality of drawer rails each supported for sliding movement on one said guide rail.

5. A storage system according to claim 4, wherein each of said cross bars and U-shaped frame members is formed as a double wire.

6. A storage system according to claim 1, wherein said drawer support frame is a wire structure.

7. A storage system according to claim 6, wherein said drawer support frame further comprises a plurality of drawer retainer rails each connecting one of said U-shaped frame members to the other thereof, at a location above and parallel to one said guide rail; and wherein said drawer is formed with a plurality of drawer rails each supported for sliding movement on one said guide rail and held in a region of said guide rail by said retaining rail.

8. A storage system according to claim 1, wherein said drawer support frame is formed of two substantially rectangularly shaped end pieces connected by a plurality of rods, at least two of said rods being offset from and inside a plane connecting the rectangular end pieces for carrying said drawer for sliding movement thereon.

9. A multiple purpose, modular storage system, comprising:

a plurality of vertical corner posts;

at least one inner corner member including post embracing means for embracing one side of one said corner post intermediate its ends, and a panel supporting section mounted with said embracing means, wherein said embracing means comprises a generally C-shaped portion formed to snap onto said corner post and an extension that extends laterally from said C-shaped portion, said extension containing a notch on its outer surface;

an outer corner member formed to mate with and be carried by said inner corner member and, in cooperation therewith, at least partially to envelop said corner post, said outer corner member being formed with a confronting extension that opposes said panel supporting section, wherein said outer corner member is formed with a protrusion that engages said notch to mate said outer corner member with said inner corner member;

a panel formed with an end portion lip sandwiched between said panel supporting section and said confronting extension; and fastening means secured through said confronting extension, said lip, and said panel supporting section, thereby for supporting said panel on said corner post.

10. A storage system according to claim 9, wherein said corner posts each have a generally triangular cross-sectional shape with rounded vertexes.

11. A storage system according to claim 9, wherein said inner corner member is an injection molded part.

12. A storage system according to claim 9, wherein said outer corner member is an extruded part.

13. A multiple purpose, modular storage system, comprising:

a plurality of substantially vertical corner posts;

at least one inner corner member mountable on at least one said corner post, said inner corner member including at least one opening for receiving a fastener, wherein said inner corner member comprises a generally C-shaped portion formed to snap onto said corner post and an extension that extends laterally from said C-shaped portion, said extension containing a notch on its outer surface;

an outer corner member formed to mate with said inner corner member, said outer corner member including at least one opening aligned with the opening in said inner corner member wherein said outer corner member has a protrusion that engages said notch to mate said outer corner member with said inner corner member;

a panel having an end portion lip sandwiched between said outer corner member and said inner corner member at the location of said aligned openings respectively therein, said end portion lip having a hole aligned with said openings in the outer corner member and the inner corner member; and fastening means secured in said openings and hole, thereby to mount said panel with said corner post.

14. A storage system according to claim 13, wherein said corner posts each have a generally triangular cross-sectional shape with rounded vertexes.

15. A modular utility storage system, comprising:

a plurality of substantially vertical corner posts;

a plurality of beams each interconnecting two of said corner posts;

an inner corner member having a generally C-shaped section, said inner corner member embracing and snapping partially around one of said corner posts, said inner corner member being formed with a notch on an outer surface of said C-shaped section and including at least one opening for receiving fastening means;

an outer corner member formed to mate with said inner corner member to at least partially envelop said corner post, said outer corner member including a protrusion engageable with said notch, and at least one opening aligned with said opening in said inner corner member when said outer corner member and inner corner members are mated; and a panel having an end portion located between said outer corner member and inner corner member, said end portion having an opening aligned with the openings in the outer corner member and inner corner member and through which fastener means can pass.

16. A utility storage system according to claim 15, wherein said corner posts have an approximate cross-sectional shape of an isosceles triangle with rounded corners and said inner corner member has an extension thereto parallel to the panel.

17. A utility storage system according to claim 15, wherein the inner corner member is an injection molded part.

18. A utility storage system according to claim 15, wherein said outer corner member is an extruded part.

19. A storage system, comprising:

a plurality of substantially vertical corner posts;

a plurality of side beams each interconnecting two of said corner posts;

a drawer support frame removably attached to two side beams by a plurality of clips, each said clip being formed of a series of planar surfaces, three of which are formed to be closely adjacent an upper and two side surfaces of said side beams, wherein said frame comprises two U-shaped frame members, two cross bars each enclosing an open end of one of said U-shaped frame members, and a plurality of drawer guide rails and retainer rails each connecting one of said U-shaped frame members to the other thereof at spaced parallel locations; and at least one drawer carried for sliding movement within said drawer support frame.

20. A storage system according to claim 19, wherein said drawer support frame is a wire structure.

21. A storage system according to claim 20, wherein said drawer support frame is formed of two substantially rectangularly shaped end pieces connected by a plurality of rods, at least two of said rods being offset from and inside a plane connecting the rectangular end pieces for carrying said drawer for sliding movement thereon.

22. A storage system according to claim 19, wherein said drawer is formed with a plurality of drawer rails each supported for sliding movement on one said guide rail and held in the region of said guide rail by said retaining rail.

* * * * *

UNITED STATES PATENT AND TRADEMARK OFFICE

CERTIFICATE OF CORRECTION

PATENT NO. : 5,205,630

DATED : April 27, 1993

INVENTOR(S) : ROBERT J. WELCH, ET AL.

It is certified that error appears in the above-identified patent and that said Letters Patent is hereby corrected as shown below:

COLUMN 3

Line 14, "In an" should read --An--.

COLUMN 10

Line 6, "paticularly" should read --particularly,--.

COLUMN 11

Line 55, "pasts;" should read --posts;--.

Signed and Sealed this

Twenty-second Day of November, 1994

*Attest:*

*Attesting Officer*

Bruce Lehman

BRUCE LEHMAN

*Commissioner of Patents and Trademarks*